US008639138B2

(12) United States Patent
Sonoda et al.

(10) Patent No.: US 8,639,138 B2
(45) Date of Patent: Jan. 28, 2014

(54) IMAGE FORMATION DEVICE, IMAGE FORMATION METHOD AND NON-TRANSITORY STORAGE MEDIUM STORING IMAGE FORMATION PROGRAM

(75) Inventors: Tetsuya Sonoda, Tokyo (JP); Shinya Watanabe, Kanagawa (JP); Hirotaka Udagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 304 days.

(21) Appl. No.: 13/112,703

(22) Filed: May 20, 2011

(65) Prior Publication Data

US 2012/0106999 A1 May 3, 2012

(30) Foreign Application Priority Data

Nov. 2, 2010 (JP) ..... 2010-246138

(51) Int. Cl.
*G03G 15/00* (2006.01)
*G03G 15/20* (2006.01)

(52) U.S. Cl.
USPC ..... 399/45; 399/68

(58) Field of Classification Search
USPC ..... 399/46, 67, 68, 82, 85
See application file for complete search history.

(56) References Cited

U.S. PATENT DOCUMENTS 8,022,347 B2 * 9/2011 Tatsuno et al. ..... 250/205
2009/0060541 A1 * 3/2009 Takeuchi ..... 399/45
2011/0026943 A1 * 2/2011 Konishi et al. ..... 399/9

FOREIGN PATENT DOCUMENTS

JP 2008-058365 A 3/2008

* cited by examiner

*Primary Examiner* — David Gray
*Assistant Examiner* — Gregory H Curran
(74) *Attorney, Agent, or Firm* — Sughrue Mion, PLLC

(57) ABSTRACT

An image formation device includes a receiving section, a formation section, a fixing section, a switching section, and a controller. The receiving section receives image formation data including image data, and sheet data which includes designations of a sheet and a corresponding fixing pressure. The formation section forms a toner image on the sheet. The fixing section fixes the toner image on the sheet. The switching section switches the fixing pressure between a first or second fixing pressure. When the fixing pressure is switched to the second fixing pressure and the fixing pressure designated by the sheet data is the first fixing pressure, the controller performs a mandatory image formation that includes a low-speed control that conveys the sheet at a speed lower than that for the first fixing pressure, and/or a toner suppression control that performs image formation with a smaller amount of toner than in normal.

13 Claims, 6 Drawing Sheets

IMAGE FORMATION DEVICE, IMAGE FORMATION METHOD AND NON-TRANSITORY STORAGE MEDIUM STORING IMAGE FORMATION PROGRAM

CROSS-REFERENCE TO RELATED APPLICATIONS

This application is based on and claims priority under 35 USC 119 from Japanese Patent Application No. 2010-246138 filed on Nov. 2, 2010.

BACKGROUND

1. Technical Field

The present invention relates to an image formation device, an image formation method and a non-transitory storage medium storing image formation program.

2. Related Art

An image formation device provided with a transfer unit that transfers a toner image formed on an image carrier to a transfer material, and a fixing unit that fixes the toner image transferred to the transfer material has been proposed. The fixing unit is replaceable by being attached to/detached from the body of the image formation device. The image formation device is further provided with a transfer material setting section that detects or specifies whether a transfer material supplied is an envelope or regular paper, a fixing unit detector that detects the type of the mounted fixing unit, a fixing unit determination section that determines whether or not the mounted fixing unit matches with the transfer material set by the transfer material setting section, and a display section that displays on a display a message which shows that the mounted fixing unit should be exchanged, in a case in which the determination result of the fixing unit determination section is negative.

SUMMARY

An aspect of the present invention is an image formation device including: a receiving section that receives image formation data including image data of an image to be formed on a sheet and sheet data relating to the sheet, the sheet data including a designation of the sheet and a designation of a fixing pressure corresponding to the sheet; a formation section that forms a toner image on the sheet in accordance with the image data; a fixing section that fixes the toner image that has been formed on the sheet; a switching section that switches, by operation of a user, the fixing pressure of the fixing section between a first fixing pressure or a second fixing pressure that is lower than the first fixing pressure; and a controller that performs a mandatory image formation in a case in which the fixing pressure is switched to the second fixing pressure and the fixing pressure corresponding to the sheet designated by the sheet data is the first fixing pressure, the mandatory image formation including at least one of a low-speed control that conveys the sheet for fixing at a speed lower than a conveying speed for the first fixing pressure, or a toner suppression control that performs image formation with a smaller amount of toner than in a normal image formation.

BRIEF DESCRIPTION OF THE DRAWINGS

Exemplary embodiments of the present invention will be described in detail based on the following figures, wherein.

DETAILED DESCRIPTION

Figure 1:
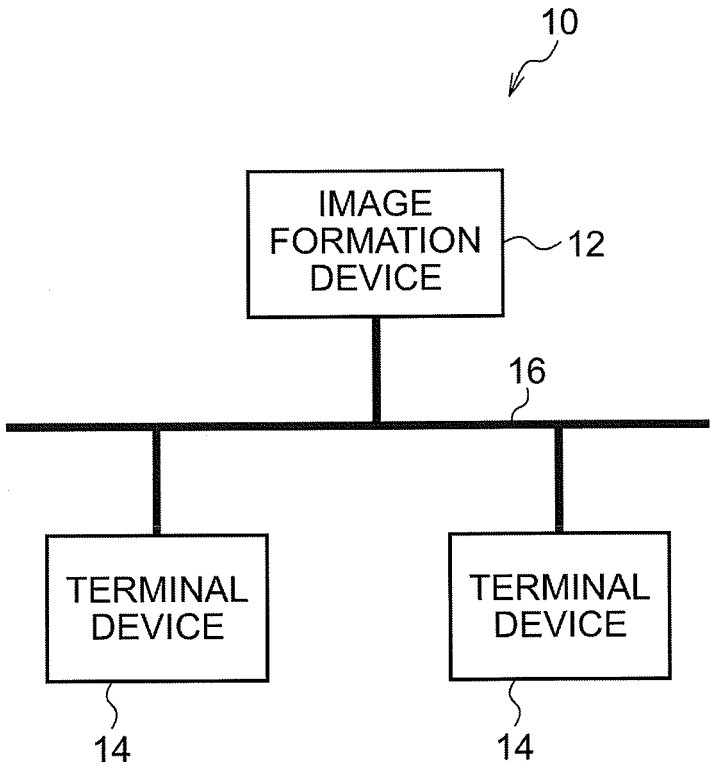
FIG. 1 is a schematic configuration diagram of an image formation system.

FIG. 1 illustrates a schematic structure of an image formation system 10 according to the present exemplary embodiment. As shown in FIG. 1, the image formation system 10 has a configuration in which an image formation device 12 and a terminal device 14 are interconnected through a network 16.

Figure 2:
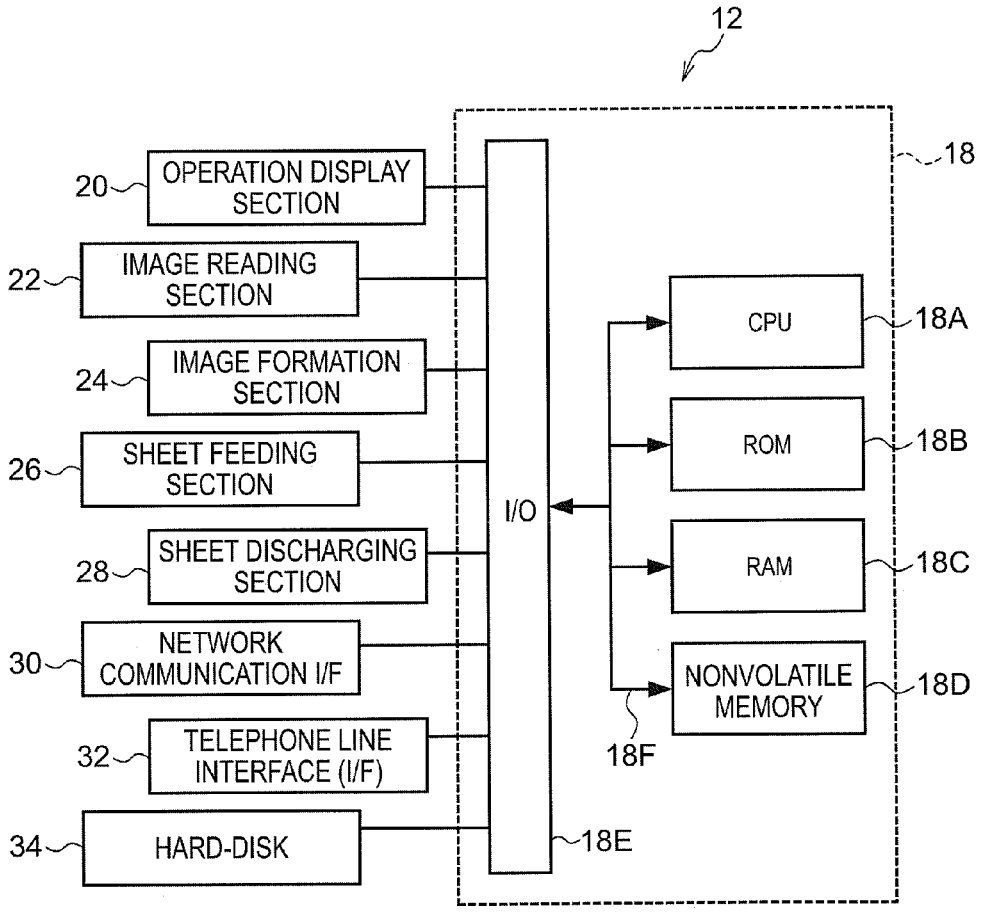
FIG. 2 is a schematic configuration diagram of an image formation device.

FIG. 2 illustrates a schematic structure of the image formation device 12. As shown in FIG. 2, the image formation device 12 includes a computer 18.

The computer 18 has a configuration in which a central processing unit (CPU) 18A, a read only memory (ROM) 18B, random access memory (RAM) 18C, a nonvolatile memory 18D and an input-output interface (I/O) 18E are connected respectively through a bus 18F.

The I/O 18 is connected to each of functional sections such as an operation display section 20, an image reading section 22, an image formation section 24, a sheet feeding section 26, a sheet discharging section 28, a network communication interface (I/F) 30, a telephone line interface (I/F) 32 and a hard-disk 34.

The operation display section 20 includes, for example, various buttons such as a start button for instructing starting of copying and a numerical keypad, a setting screen for setting parameters of various image formation conditions such as copy density or the like, and a touch panel for displaying various screens indicating a state of the device or the like.

The image reading section 22 includes an image reading sensor such as a line CCD and a scanning mechanism for scanning the image reading sensor, and reads an image on an original set on the device.

The image formation section 24 forms an image on a recording medium using an electrophotographic method for example. Specifically, the image formation section 24 includes a charging device for charging a photosensitive drum, an exposure device which forms an electrostatic latent image corresponding to an image on the photosensitive drum by exposing the charged photosensitive drum with light corresponding to the image, a developing device which carries out toner development of the electrostatic latent image formed on the photosensitive drum, a transferring device which transfers the toner image corresponding to the image formed on the photosensitive drum to a recording medium, and a fixing device 36, such as shown in FIG. 3, which fixes the toner image corresponding to the image transferred to the recording medium, and the like.

As the exposure device, a light scanning device including an optical system such as a semiconductor laser, a rotary polygon mirror, a collimator lens, a cylindrical lens or an fθ lens, an LED head including plural LEDs, or the like may be used.

Figure 3:
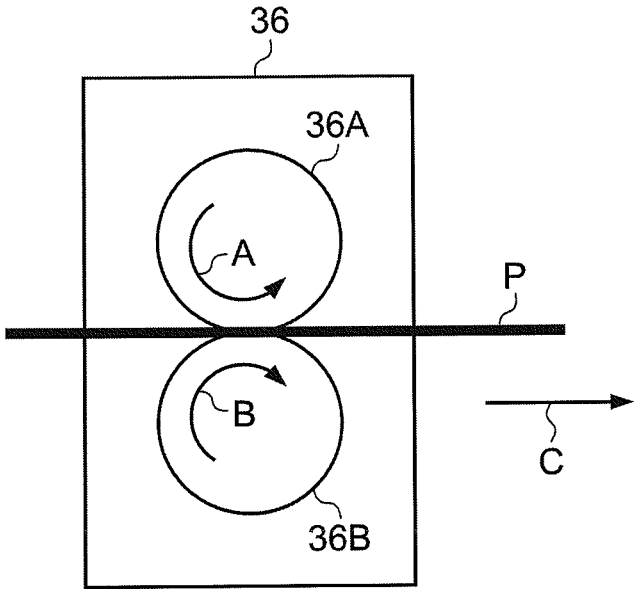
FIG. 3 is a schematic configuration diagram of a fixing device.

As shown in FIG. 3, the fixing device 36 has, as an example, a heating roll 36A which includes a heater such as a halogen lamp inside a metallic core having high thermally conductivity and rotates in a direction of arrow A in FIG. 3, and a press roll 36B which is disposed so as to face the heating roll 36A and rotates in a direction of arrow B in FIG. 3. A sheet P on which a toner image corresponding to an image has been formed is sandwiched between the heating roll 36A which rotates in the arrow A direction and the press roll 36B which rotates in the arrow B direction, and conveyed in a direction of arrow C in FIG. 3. Thereby, the toner image formed on the sheet P is heated and fixed thereon.

The fixing device 36 is configured such that a fixing pressure for fixing the toner image on the sheet P, that is, a pressure which the press roll 36B applies to the heating roll 36A, can be switched between a first fixing pressure and a second fixing pressure. The first fixing pressure is a fixing pressure suitable for fixing toner images formed on sheets which are usually used, such as plain paper for example. The second fixing pressure is a fixing pressure suitable for fixing toner images formed on materials, such as envelopes or the like, in which there is a greater possibility of generating wrinkling if the fixing of the toner images is performed with the first fixing pressure as compared with a case of using plain paper. The second fixing pressure is lower than the first fixing pressure. In the present exemplary embodiment, a pressure for fixing a toner image on a sheet other than an envelope, such as plain paper, is defined as the first fixing pressure, and a fixing mode fixing with the first fixing pressure is called a normal mode. Further, a pressure for fixing a toner image on an envelope is defined as the second fixing pressure, and a fixing mode fixing with the second fixing pressure is called an envelope mode.

Figure 4A:
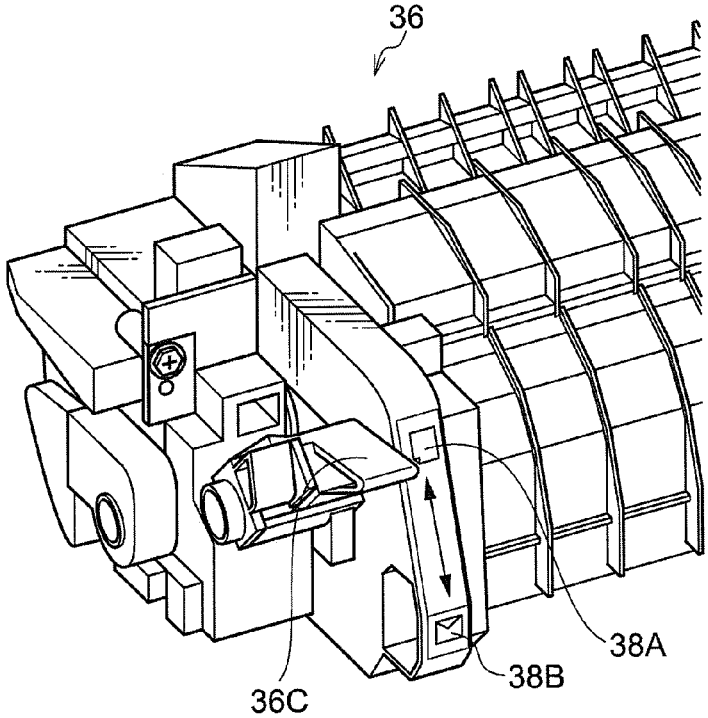
FIG. 4A and FIG. 4B are perspective views showing a part of an outer appearance of the fixing device.
Figure 4B:
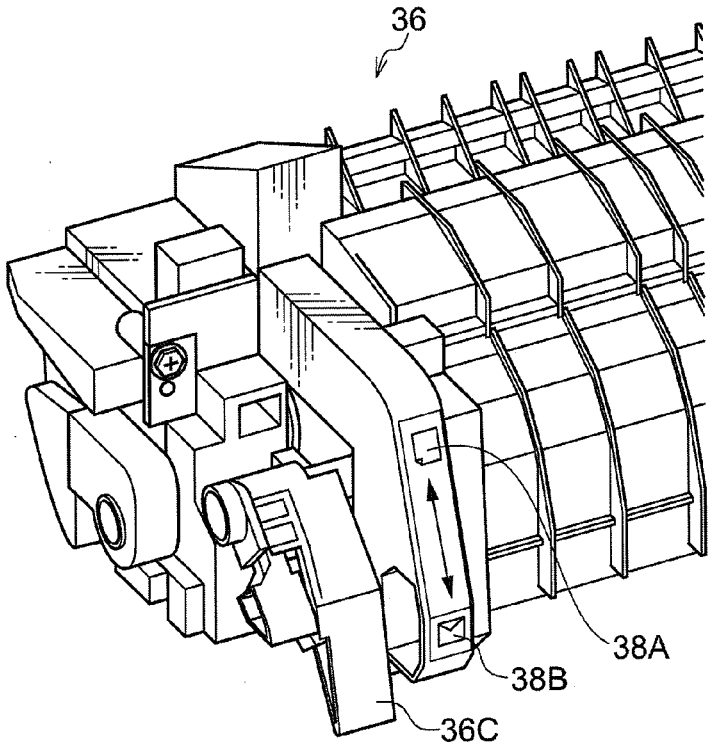

FIG. 4A and FIG. 4B show partial perspective views of the outer appearance of the fixing device 36. As shown in FIG. 4A, the fixing device 36 is provided with a switching lever 36C for switching the fixing pressure. When this switching lever 36C is positioned at a mark 38A which indicates plain paper, the mode has been switched to the normal mode, that is, the mode in which fixing is performed with the first fixing pressure. When the switching lever 36C is positioned at a mark 38B which indicates an envelope, the mode has been switched to the envelope mode, that is, the mode in which fixing is performed with the second fixing pressure which is lower than the first fixing pressure.

Thus, the fixing device 36 is configured so that the pressure applied to the heating roll 36A by the press roll 36B is switched, according to a switching operation of the switching lever 36C by a user. The position of the switching lever 36C is detected by a sensor which is not illustrated, and information (data) indicating which position the switching lever 36C is positioned at is stored, for example, in a memory in the image formation section 24 which is not illustrated. The CPU 18A makes an inquiry for the data indicating the position of the switching lever 36C to the image formation section 24, thereby acquiring the data indicating the present position of the switching lever 36C.

The user may switch the switching lever 36C to the envelope mode when the user wishes to print on an envelope, and may switch the switching lever 36C to the normal mode when the user wishes to print on a sheet other than an envelope, such as plain paper. Then, the user may instruct printing from the terminal device 14, or instruct copying by operating the operation display section 20. Thereby, a toner image can be fixed with the fixing pressure suitable for each sheet.

The sheet feeding section 26 includes a sheet housing section in which recording sheets are housed, a feeding mechanism which feeds the recording sheets from the sheet housing section to the image formation section 24, and the like. The sheet housing section has plural housing sections such as a housing section which houses plain paper or the like, and a housing section which houses envelopes or the like.

The sheet discharging section 28 includes a discharging section to which recording mediums are discharged, a discharging mechanism for discharging sheets on which images are formed by the image formation section 24 onto the discharging section, and the like.

The network communication I/F 30 is an interface for performing data communication with the terminal device 14 or the like through the network 16.

The telephone line communication I/F 32 is an interface for performing facsimile communication with another image formation device connected through a telephone line which is not illustrated.

The hard-disk 34 stores, for example, log data relating to statuses of respective sections of the device, operation statuses and the like, log data relating to processing results of copying, facsimile communication, printing and the like, various types of setting data, and control programs.

In the present exemplary embodiment, a control program for processing which will be described below is stored in advance in the hard-disk 34, and is performed by the CPU 18A which reads this control program stored in advance. Alternatively, the control program may be stored in a storage medium such as a CD-ROM, and may be performed by being read via a CD-ROM drive or the like.

The terminal device 14 may be configured by, for example, an ordinary personal computer. In a case in which printing is instructed by a user, the terminal device 14 transmits to the image formation device 12 image formation information (data) including image information (data) relating to an image which is to be formed on a sheet, and sheet information (data) relating to the type of the sheet. The sheet data referred to in the present exemplary embodiment is data designating the type of sheets, such as plain paper or envelopes. The "image" in the present exemplary embodiment includes images in various forms, such as an image including only text (characters), an image including photographs and graphics, or the like.

When the user wishes to print an address or the like on an envelope, for example, the user may switch the switching lever 36C to the envelope mode, and when the user wishes to print on a sheet other than an envelope, such as plain paper, the user may switch the switching lever 36C to the normal mode. Then, the user may perform print instruction by designating an envelope or plain paper as sheet data from the terminal device 14, and transmitting the sheet data along with the image data to the image formation device 12 through the network 16.

When image formation data including the image data and the sheet data transmitted from the terminal device 14 through the network 16 is received, the image formation device 12 forms an image on the designated sheet based on the received image formation data.

Further, when receiving the image formation data from another device via facsimile communication through the telephone line, the image formation device 12 forms the image on the designated sheet based on the received image formation data.

Furthermore, in a case in which the user sets an original on the image reading section 22 and designates the type of sheet by operating the operation display section 20, the image formation device 12 forms the image of the original read by the image reading section 22 on the designated sheet.

Next, processing performed by the CPU 18A of the image formation device 12 will be explained as an operation of the present exemplary embodiment with reference to a flowchart shown in FIG. 5.

This processing is performed, for example, in the case in which the image formation data is received from another device through the telephone line by facsimile communication, in the case in which the image formation data is received through the network 16 from the terminal device 14, and in the case in which the user sets the original on the image reading section 22 and instructs copying thereof.

First, in step 100, the CPU 18A judges whether or not the fixing device 36 is set in the envelope mode. Specifically, the CPU 18A acquires the data indicating the position of the switching lever 36C from the image formation section 24, and judges, based on the data, whether the switching lever 36C has been switched to the position of the envelope mode, that is, to the mode performing fixing with the second fixing pressure.

If the switching lever 36C is at the position of the envelope mode, the processing proceeds to step 102, and if the switching lever 36C is not at the position of the envelope mode, that is, at the position of the normal mode, the processing proceeds to step 116.

In the step 102, the CPU 18A judges whether or not the sheet designated by the sheet data included in the received image formation data is a sheet other than the envelope. In a case in which the designated sheet is other than the envelope, that is, in a case in which the sheet designated by the sheet data and the sheet corresponding to the position of the switching lever 36C do not match, the processing proceeds to step 104. In a case in which the sheet designated by the sheet data and the sheet corresponding to the position of the switching lever 36C match, the processing proceeds to step 114.

In the step 116, the CPU 18A judges whether or not the sheet designated by the sheet data included in the received image formation data is the envelope. In a case in which the designated sheet is the envelope, that is, in a case in which the sheet designated by the sheet data and the sheet corresponding to the position of the switching lever 36C do not match, the processing proceeds to step 118. However, in a case in which the designated sheet is other than the envelope, that is, the sheet designated by sheet data and the sheet corresponding to the position of the switching lever 36C match, the processing proceeds to the step 114.

In the step 118, the CPU 18A displays on the operation display section 20 a warning message which prompts the user to switch the switching lever 36C to the normal mode. In a case of a print instruction from the terminal device 14, an instruction may be sent to the terminal device 14 to display the warning message.

In the step 104, the CPU 18A judges, based on the image data included in the image formation data, whether or not any image is included in the image data to be rendered, that is, whether the image data indicates blank or not. In a case in which an image is included in the image data to be rendered, the processing proceeds to step 106, and in a case in which no image is included in the image data to be rendered, that is, in a case in which the image data indicates blank, the processing proceeds to the step 114.

In the step 106, the CPU 18A judges whether or not the current processing satisfies mandatory image formation conditions which are predetermined, and which are conditions for performing mandatory image formation even if the switching lever 36C indicates the envelope mode and the designated sheet is a sheet other than the envelope.

Cases which satisfy the mandatory image formation conditions, for example, include cases which satisfy at least one of: a case in which the number of pixels of the image to be formed corresponding to the image data is equal to or lower than a predetermined threshold value; a case in which the image to be formed is monochrome; a case in which the image to be formed includes only text; a case in which the processing is performed in response to facsimile reception; and a case in which the processing is performed in a predetermined time range during which the user of the image formation device 12 leaves, such as at night.

The threshold value may be set to a value at which it is considered that fixing defects would not occur if the number of pixels is equal to or lower than this value, as an example. The reason for mandatorily performing the image formation in the cases in which the number of pixels of the image to be formed corresponding to the image data is equal to or lower than the predetermined threshold value, the image to be formed is monochrome, or the image to be formed includes only text, is that it is considered that in these cases, amounts of toner are small and the fixing defects are less likely to occur even if the image formation is performed mandatorily. Further, the reason for mandatorily performing the image formation in the cases in which the processing is performed in response to facsimile reception or the processing is performed in the predetermined time range such as at night, is that, if the image formation stops in such situations, there may be cases in which the processing remains stopped in a state in which a user does not notice for a long time, which is not preferable.

In a case in which the current processing satisfies the mandatory image formation conditions described above, the processing proceeds to step 108. Otherwise, the processing proceeds to step 118 and performs the above-described processes.

In the step 108, the CPU 18A performs a toner suppression control. This toner suppression control is a processing of, for example, instructing the image formation section 24 so as to perform the image formation with a smaller amount of toner than in the usual image formation processing, i.e., the usual image formation process which is performed when the sheet designated by the sheet data and the sheet corresponding to the position of the switching lever 36C match. For example, the amount of toner is reduced so that the density of the whole image is lowered. Thereby, although the image to be formed will have relatively lower density on the whole than when the image formation is performed by the usual image formation process, it is possible to suppress occurrence of fixing defects.

Alternatively, based on the received image data, image data in which the amount of toner required is less than in the case of performing the usual image formation processing, namely, image data in which the density of the whole image is reduced, may be generated, and output to the image formation section 24. The amount of toner is set to be an amount such that fixing defects do not occur and the image can be well recognized to some extent.

In step 112, the CPU 18A performs a low-speed control which makes the conveying speed at the time of fixing a low speed. Specifically, the CPU 18A instructs the image formation section 24 so that the conveying speed of the sheet at the time of image fixing onto the sheet at the fixing device 36 is changed to a lower speed than in the usual image formation processing, for example to a half speed thereof. Thereby, in the image formation section 24, since the conveying speed at the time of image fixing onto the sheet is made low, it is possible to suppress occurrence of fixing defects even if a sheet other than the envelope undergoes fixing with the second fixing pressure which is lower than the first fixing pressure.

In the step 114, the CPU 18A causes the image formation section 24 to perform the image formation processing for one sheet. In a case in which the mandatory image formation is performed even though the fixing mode is the envelope mode and the designated sheet is other than the envelope, image data of a composite image may be generated so that a message or a sign or the like, which indicates that the mandatory image formation has been performed, is printed in combination with the image to be formed, and the image data of the composite image may be output to the image formation section 24. Alternatively, instead of printing the composite image, a message or a sign or the like, which indicates that the mandatory image formation has been performed, may be printed on another sheet. Thereby, the user may understand that the mandatory image formation has been performed. Further, in a case in which the mandatory image formation is performed, the image data may be stored in the hard-disk 34. Thereby, in a case in which printing is instructed again after returning the switching lever 36C to the normal mode, it is not necessary to transmit the image data again from the terminal device 14 to the image formation device 12.

Then, in step 115, the CPU 18A judges whether or not the current sheet is the last sheet. If the current sheet is the last sheet, the routine is ended, and the processing returns to the step 100. Otherwise, the processing repeats the above described steps.

Although the present exemplary embodiment describes the case in which both the toner suppression control and the low-speed control are performed, embodiments are not limited thereto, and either of them may be performed.

Further, since there is generally a small amount of toner required in a case in which the image to be formed is monochrome or an image including only text, there may be cases in which it is not necessary to reduce the conveying speed at the time of fixing to a lower speed than in the usual image formation processing. Therefore, in the cases in which the image to be formed is monochrome or includes only text, the step 112 may not be performed. FIG. 6 shows a flowchart of processing in this case. The difference between the processes in FIG. 6 and the processes in FIG. 5 is only that step 110 is added in FIG. 6. In the step 110, it is judged whether or not the image to be formed is a monochromatic image or the image includes only text. If the image to be formed is a monochromatic image or includes only text, the processing proceeds to the step 114 without performing the low-speed control, and otherwise, the processing proceeds to the step 112 and performs the low-speed control.

Figure 5:
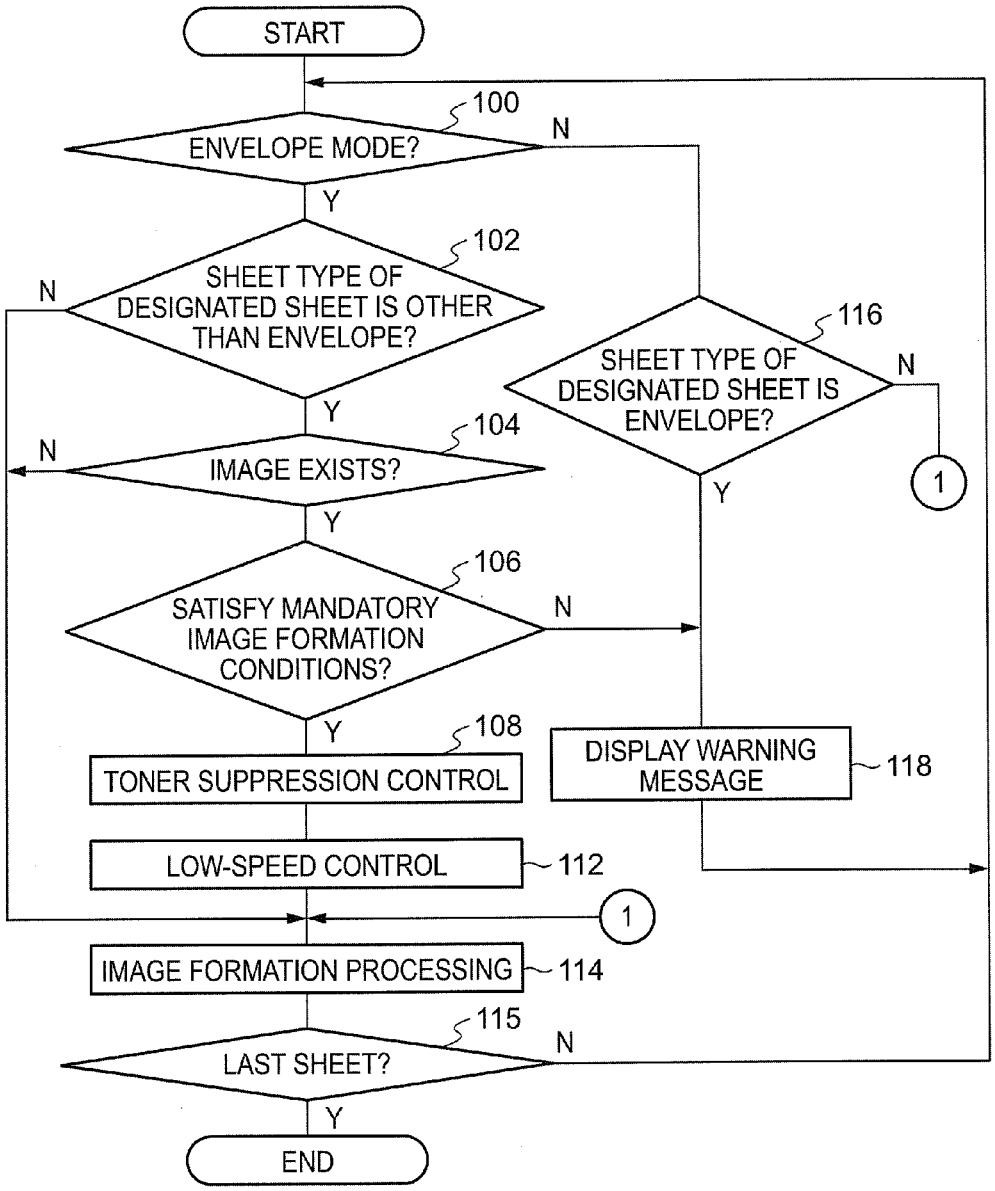
FIG. 5 is a flowchart of the process performed by the image formation device.
Figure 6:
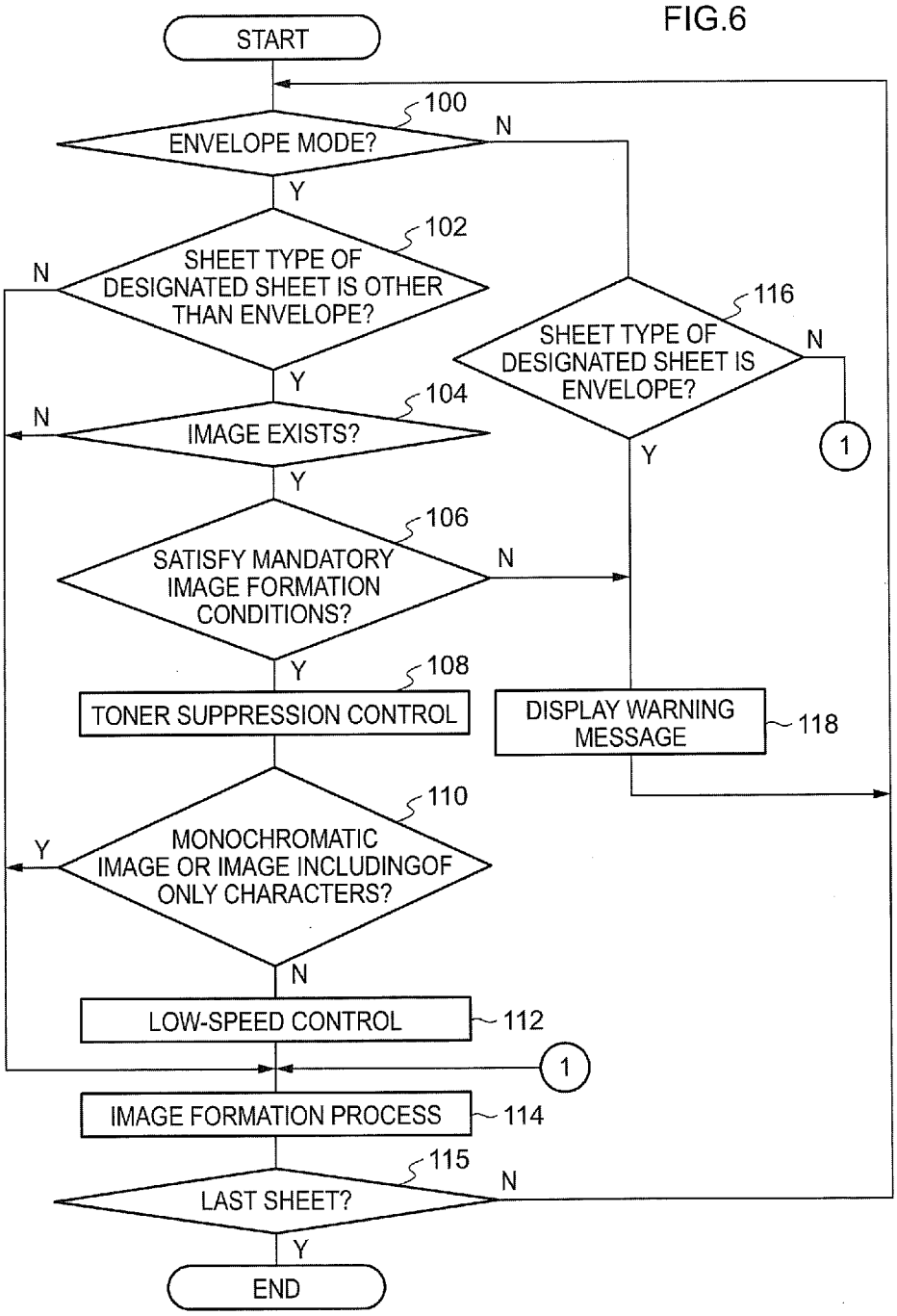
FIG. 6 is a flowchart of the process performed by the image formation device.

The processing of FIG. 5 and FIG. 6 may not be performed in a case of copying which is instructed to be performed by a user by operating the image formation device 12. That is, in the case of such copying, if the fixing mode is set to the envelope mode and the designated sheet is other than the envelope, it is sufficient to display on the operation display section 20 an indication to return the switching lever 36C to the normal mode, and cause the user to return the switching lever 36C to the normal mode.

The present exemplary embodiment describes the case in which the fixing mode is switched to either the normal mode or the envelope mode. However, embodiments are not limited thereto, and a configuration may be made such that the fixing mode can be selected from three or more fixing modes.

It should be understood that the configuration of the image formation device 12 (refer to FIG. 2) described in the above embodiment is merely presented as an example, and a person skilled in the art may omit unnecessary parts or add new parts without departing from the spirit and scope of the present invention.

Moreover, it should be understood that the flow of the processing of the controlling program (refer to FIG. 5 and FIG. 6) explained in the exemplary embodiment is merely presented as an example, and a person skilled in the are may omit unnecessary steps, add new steps, and replace the order of the steps without departing from the spirit and scope of the present invention.

What is claimed is:

1. An image formation device comprising:

a receiving section that receives image formation data including image data of an image to be formed on a sheet and sheet data relating to the sheet, the sheet data including a designation of the sheet and a designation of a fixing pressure corresponding to the sheet;

a formation section that forms a toner image on the sheet in accordance with the image data;

a fixing section that fixes the toner image that has been formed on the sheet;

a switching section that switches, by operation of a user, the fixing pressure of the fixing section between a first fixing pressure or a second fixing pressure that is lower than the first fixing pressure; and a controller that performs a mandatory image formation in a case in which the fixing pressure is switched to the second fixing pressure and the fixing pressure corresponding to the sheet designated by the sheet data is the first fixing pressure, the mandatory image formation includes a toner suppression control that performs image formation with a smaller amount of toner than in a normal image formation.

2. The image formation device according to claim 1, wherein in the case of performing the toner suppression control, the controller outputs the image data to the formation section, and instructs the formation section to form a toner image on the sheet with an amount of toner that is less than an amount of toner indicated by the image data.

3. The image formation device according to claim 1, wherein in the case of performing the toner suppression control, the controller generates new image data that requires an amount of toner that is less than an amount of toner indicated by the image data, and outputs the generated new image data to the formation section.

4. The image formation device according to claim 1, wherein the controller performs the mandatory image formation in a case in which the image according to the image data is a monochromatic image.

5. The image formation device according to claim 1, wherein the controller performs the mandatory image formation in a case in which the image indicated by the image data includes only text.

6. The image formation device according to claim 1, wherein the controller performs the mandatory image formation in a case in which the number of pixels of the image indicated by the image data is equal to or less than a predetermined threshold value.

7. The image formation device according to claim 1, wherein the controller performs the mandatory image formation in a predetermined time range.

8. The image formation device according to claim 1, wherein the controller performs the mandatory image formation in a case in which an image received by facsimile is to be formed on the sheet.

9. The image formation device according to claim 1, wherein the controller performs a low-speed control in a case in which the image according to the image data is a monochromatic image or an image including only text.

10. The image formation device according to claim 1, wherein the controller controls the formation section so that information indicating that the mandatory image formation has been performed is formed on the sheet, or information indicating that the mandatory image formation has been performed is formed on a sheet other than the sheet on which the image formation is performed.

11. The image formation device according to claim 1, further comprising a storage section, wherein the controller causes the image formation data to be stored in the storage section in a case in which the mandatory image formation is performed.

12. An image formation method comprising:

receiving image formation data including image data of an image to be formed on a sheet and sheet data relating to the sheet, the sheet data including a designation of the sheet and a designation of a fixing pressure corresponding to the sheet;

forming on the sheet a toner image in accordance with the image data;

fixing the toner image that has been formed on the sheet;

switching, by operation of a user, the fixing pressure for fixing between a first fixing pressure or a second fixing pressure that is lower than the first fixing pressure; and performing a mandatory image formation in a case in which the fixing pressure is switched to the second fixing pressure and the fixing pressure corresponding to the sheet designated by the sheet data is the first fixing pressure, the mandatory image formation includes a toner suppression control that performs image formation with a smaller amount of toner than in a normal image formation.

13. A non-transitory storage medium storing a program that causes a computer to execute image formation processing, the image formation processing comprising:

receiving image formation data including image data of an image to be formed on a sheet and sheet data relating to the sheet, the sheet data including a designation of the sheet and a designation of a fixing pressure corresponding to the sheet;

forming on the sheet a toner image in accordance with the image data;

fixing the toner image that has been formed on the sheet;

switching, by operation of a user, the fixing pressure for fixing between a first fixing pressure or a second fixing pressure that is lower than the first fixing pressure; and performing a mandatory image formation in a case in which the fixing pressure is switched to the second fixing pressure and the fixing pressure corresponding to the sheet designated by the sheet data is the first fixing pressure, the mandatory image formation includes a toner suppression control that performs image formation with a smaller amount of toner than in a normal image formation.

* * * * *